US005551363A

United States Patent [19]

Cipolla et al.

[11] Patent Number: 5,551,363

[45] Date of Patent: Sep. 3, 1996

[54] UNDERWATER VEHICLE AND A COMBINATION DIRECTIONAL CONTROL AND CABLE INTERCONNECT MEANS

[75] Inventors: Jeffrey L. Cipolla, Newport, R.I.; Ronald E. Waclawik, Fairhaven, Mass.; Charles L. Elste, Portsmouth, R.I.

[73] Assignee: The United States of America as represented by the Secretary of the Navy, Washington, D.C.

[21] Appl. No.: 411,234

[22] Filed: Mar. 27, 1995

[51] Int. Cl.[6] ..... F42B 19/06

[52] U.S. Cl. ..... 114/23; 114/330; 114/144 R

[58] Field of Search ..... 114/23, 20.1, 163, 114/162, 144 R, 280, 282, 274, 330, 331

[56] References Cited

U.S. PATENT DOCUMENTS

| | | | |
|---|---|---|---|
| 1,295,355 | 2/1919 | Myers | 114/20.1 |
| 1,410,877 | 3/1922 | Bell et al. | 114/280 |
| 2,914,014 | 11/1959 | Carl et al. | 114/281 |
| 2,980,047 | 4/1961 | Korganoff et al. | 114/313 |
| 3,459,146 | 8/1969 | Prior | 114/280 |
| 4,207,830 | 6/1980 | Wankel | 114/274 |
| 4,890,568 | 1/1990 | Dolengowski | 114/246 |
| 5,291,194 | 3/1994 | Ames | 340/850 |

*Primary Examiner*—Michael J. Carone
*Assistant Examiner*—Christopher K. Montgomery
*Attorney, Agent, or Firm*—Michael J. McGowan; Prithvi C. Lall; Michael F. Oglo

[57] ABSTRACT

There is presented an assembly comprising an underwater vehicle and a combination directional control and cable interconnect means therefor. The underwater vehicle remains underwater during travel of the vehicle through water. The directional control and cable interconnect means comprise arms extendible from sides of the underwater vehicle. Each of the arms includes a multiplicity of fins in a compact array for contact with the water through which the vehicle moves, each of the fins having an uncambered, neutral lift cross-section matching hydrodynamic streamline flow thereabout at predetermined vehicle speed below the cavitation threshold.

15 Claims, 7 Drawing Sheets

UNDERWATER VEHICLE AND A COMBINATION DIRECTIONAL CONTROL AND CABLE INTERCONNECT MEANS

STATEMENT OF GOVERNMENT INTEREST

The invention described herein may be manufactured and used by or for the Government of the United States of America for governmental purposes without payment of any royalties thereon or therefor.

CROSS-REFERENCE TO RELATED PATENT APPLICATIONS

This patent application is co-pending with three related patent applications entitled A Water Vehicle And A Directional Control Device Therefor Ser. No. 08/411,237, filed 27 Mar. 1995 pending, A Water Vehicle And Directional Control Means Therefor Ser. No. 08/411,236, filed 27 Mar. 1995 pending, and An Underwater Vehicle And Combination Directional Control And Cable Interconnect Device Ser. No. 08/411,235, filed 27 Mar. 1995 pending.

BACKGROUND OF THE INVENTION (1) Field of the Invention

This invention relates to an underwater vehicle and a combination directional control and cable interconnect means therefor, and is directed more particularly to an underwater vehicle which remains underwater during travel of the vehicle and a combination directional control and cable interconnect means extendible from the vehicle and operative in an underwater environment to maneuver the vehicle and engage and interconnect with a generally vertical cable.

(2) Description of the Prior Art

Current directional control devices for water vehicles are of two basic types, fins and thrusters. Fins typically are mounted at the aft end of the vehicle or, in the case of an underwater vehicle, on the sail or bow. The effect of fins on the directional control of the vehicle is proportional to the flow rate across the fins. Thus, at low speeds the effectiveness of fins is diminished. Thrusters are effective at low speeds because they produce their own flow, but are noisy, consume power, occupy more space, and are more complex and expensive than fins.

There is thus a need for a fin-type control device which is effective at low vehicle speeds.

It is known to provide an unmanned underwater vehicle (UUV) which is adapted to engage a generally vertical communication cable extending in a water column between a lower free-floating buoy and an upper free-floating pod and adapted to ride along the cable into interlocking engagement with the pod. Typically, the UUV is provided with a communication line extending to a control vessel, such as a submarine. A controlled body, such as a torpedo, is deployed in water and has extending therefrom a communication line connected at a remote end to the submerged free-floating buoy. The buoy is connected by the communication cable to the free-floating pod which is of greater buoyancy than the buoy. Thus, the pod floats above the buoy with the communications cable disposed generally vertically therebetween. In operation, the UUV is maneuvered into contact with the vertical cable between the buoy and the pod, connects to the cable, and rides along the cable to a point wherein the UUV engages the pod. Communication is established between the UUV and the pod which effects communication between the submarine and the torpedo, such that from a relatively safe distance the submarine may send instructions to the torpedo.

To enable the UUV to intercept and interconnect with the cable, the UUV is provided with arm means extending from the vehicle. The structure and operation of the arm means is shown and described in U.S. Pat. No. 5,291,194, issued Mar. 1, 1994 in the name of Gregory H. Ames. The arm means disclosed in the '194 patent occupies a major portion of the length of the UUV to which it is attached, and detracts from the directional maneuverability of the UUV.

Accordingly, in the provision of fin-type control devices extending from UUVs, it is desirable that such devices be, to the extent possible, combined with the cable interconnect features disclosed in the '194 patent.

Thus, there is a need for an underwater vehicle having thereon a combination directional control and cable intercept means, so as to improve directional stability and minimize the number of projections extending from the vehicle hull.

SUMMARY OF THE INVENTION

It is, therefore, an object of the invention to provide an underwater vehicle and a combination directional control and cable interconnect means therefor, the latter including fin-type devices effective for directional control at low vehicle speeds and adapted to intercept a cable.

With the above and other objects in view, as will hereinafter appear, a feature of the present invention is the provision of an underwater vehicle and a combination directional control and cable interconnect means, the underwater vehicle remaining underwater during travel of the vehicle through the water, the directional control and cable interconnect means comprising symmetrically disposed arms extendible from sides of the underwater vehicle. The arms include a multiplicity of fins in a compact array for contact with the water through which the vehicle moves in its travel, each of the fins of the array having an uncambered, neutral lift cross-section matching the hydrodynamic streamline flow therabout at predetermined vehicle speed below the cavitation threshold.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
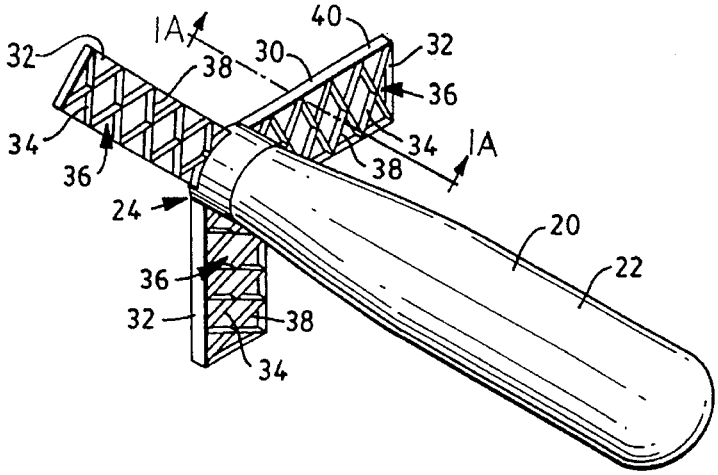
FIG. 1 is a perspective view of an underwater vehicle in combination with directional control and cable interconnect devices, illustrative of an embodiment of the invention.

Referring to FIG. 1, it will be seen that an illustrative underwater vehicle 20 and combination directional control and interconnect means 30 includes an unmanned underwater vehicle (UUV) 22 and arms 32 extending from an aft portion 24 of UUV 22. The UUV 22 remains submerged during travel of the vehicle through the water.

Figure 1A:
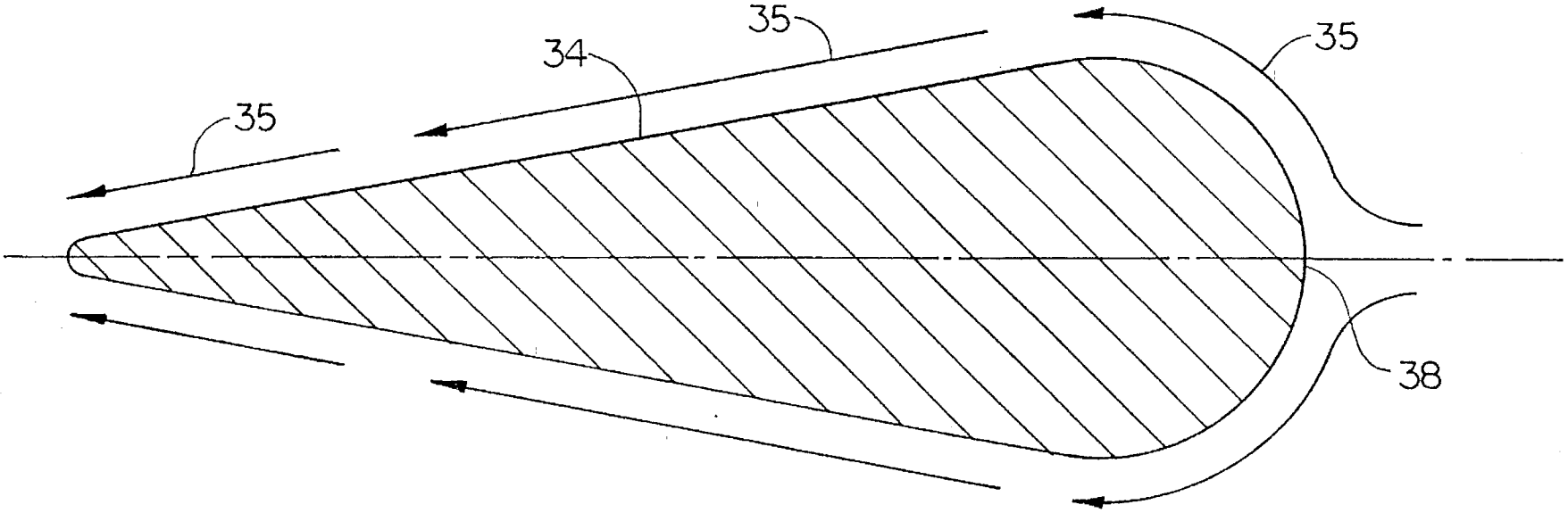
FIG. 1A is a somewhat diagrammatic section of a fin element of the directional control device taken along section line 1A—1A, FIG. 1.

Each of the arms 32 includes a multiplicity of fins 34 in a compact array 36 for contact with the water through which the vehicle moves. Referring now the FIG. 1A, each fin 34 preferably has a neutral-lift, uncambered, shape of cross section chosen to substantially match the hydrodynamic streamlines about the fin present during movement of vehicle 20 through water at below-cavitation-threshold speed, represented by flow arrows 35. Such shape of streamlines is obtainable employing principles of analysis known to those having skill in the art. One such embodiment, shown in FIG. 1A, has a cross sectional shape of an ellipsoidal leading edge 38 with a taper pinched trailing edge.

The array 36 of many relatively short fins oriented generally in the direction of water flow about the vehicle, presents a large surface area when disposed at a selected angle to the flow. The device produces a high force/movement, even at low speeds.

Figure 2:
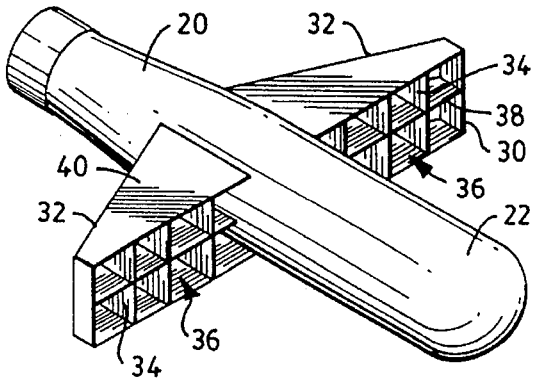
FIG. 2 is a perspective view, similar to FIG. 1, illustrative of an alternative embodiment of the invention.
Figure 3:
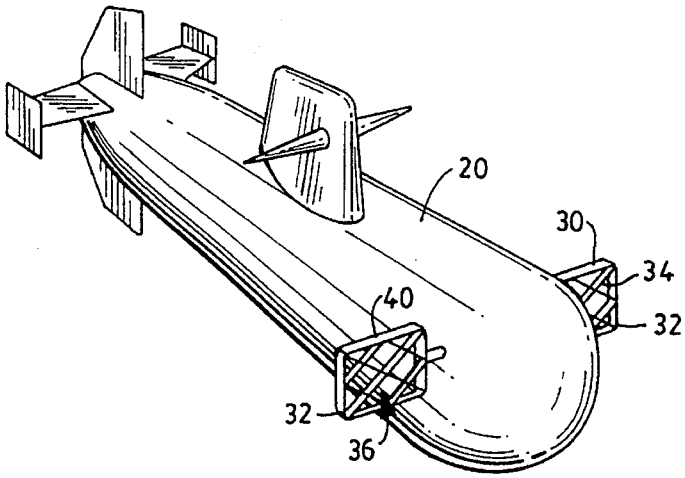
FIG. 3 is a perspective view, similar to FIG. 2, illustrative of another alternative embodiment of the invention.
Figure 4:
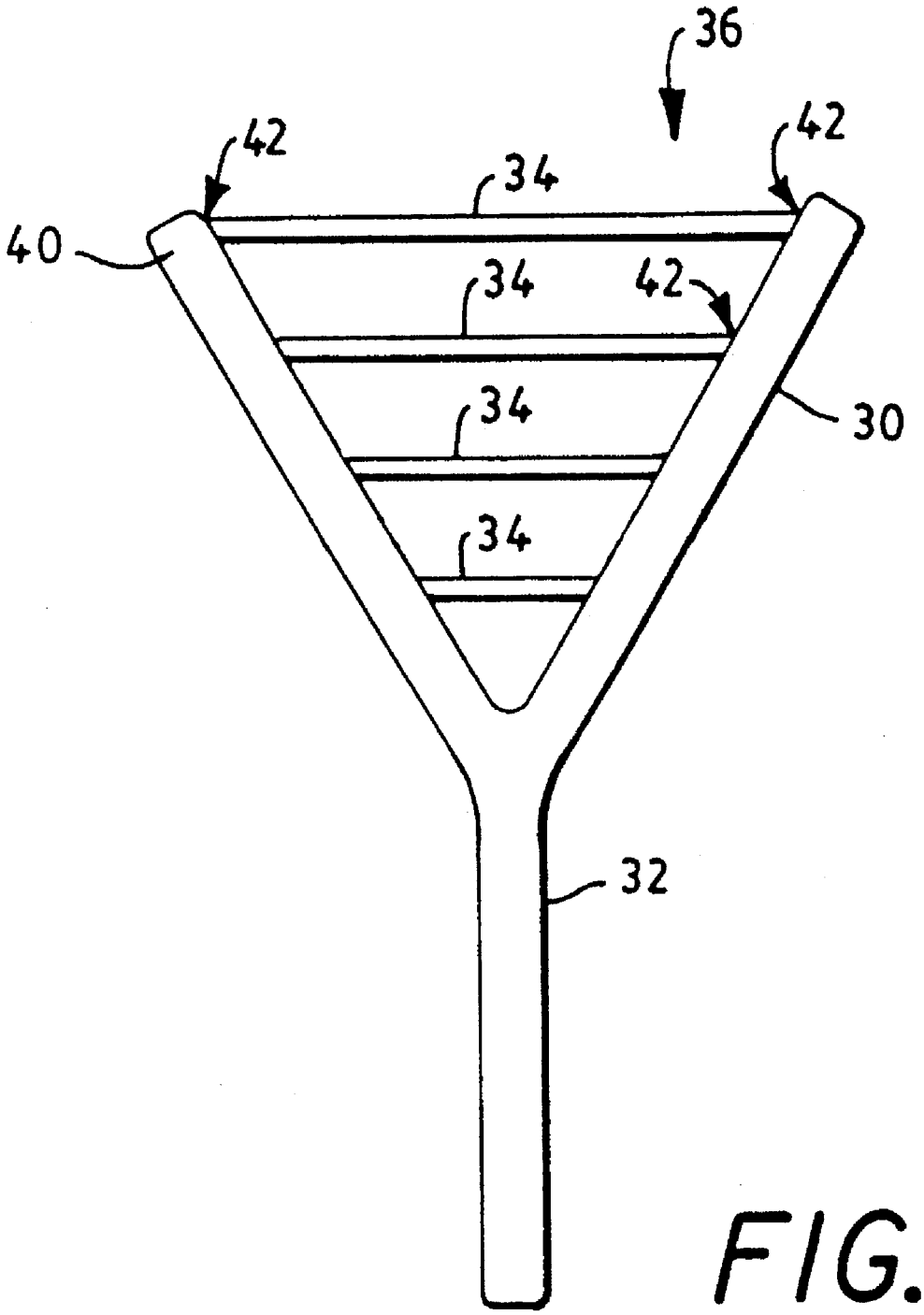
FIG. 4 is a front elevational view of a control and cable interconnect device, illustrative of an alternative embodiment thereof.
Figure 5:
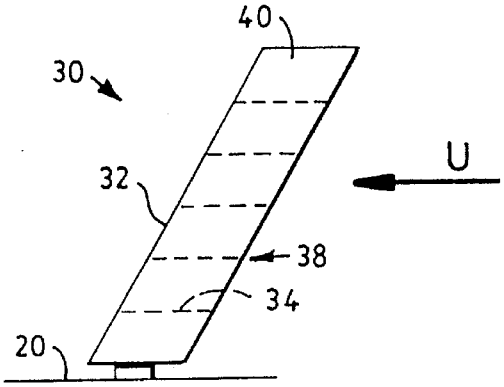
FIG. 5 is a side elevational view of a control and interconnect device, illustrative of an alternative operative disposition thereof.

Symmetrically arranged compact arrays 36 are mounted on the vehicle 20 at the aft end (FIG. 1), amidship (FIG. 2), or in a bow position (FIG. 3). The fins 34 may be surrounded by, and attached to, a shroud 40, as shown in FIGS. 1–3, or may be of a configuration, as shown in FIG. 4, wherein all ends 42 of fins 34 are fixed to the shroud 40, but the shroud does not necessarily surround the fins While the arms 32 shown in FIGS. 1–3 extend outwardly, substantially normal to the axis of the vehicle, it will be seen in FIG. 5 that the array 36 of fins may be extended in a position angled forwardly. Alternatively, the array may be curved forwardly, as shown in FIG. 7.

Figure 6:
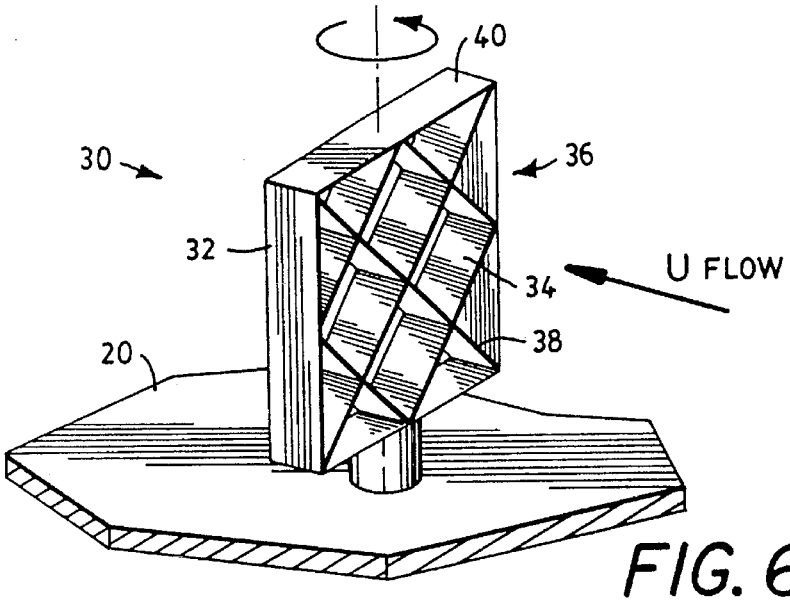
FIGS. 6 and 7 are perspective views of control and interconnect devices adapted for rotative movement.
Figure 7:
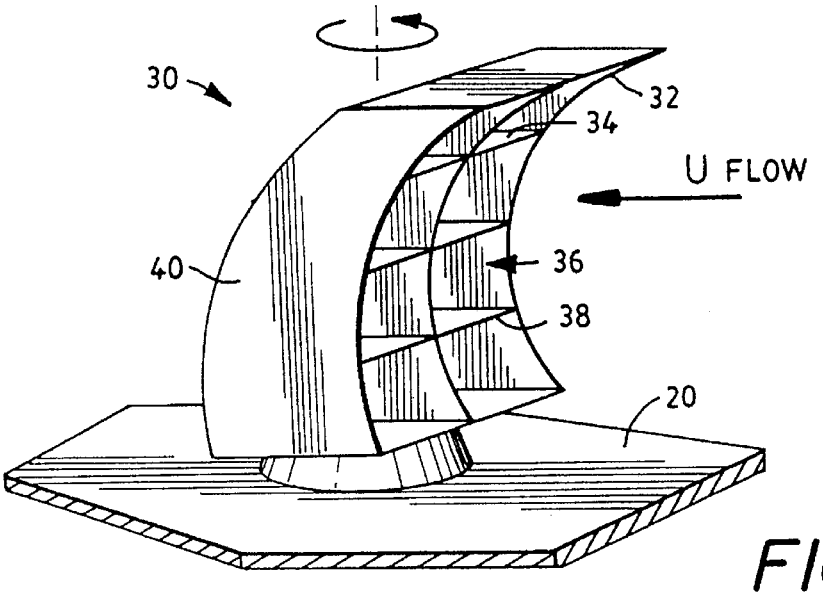
Figure 8:
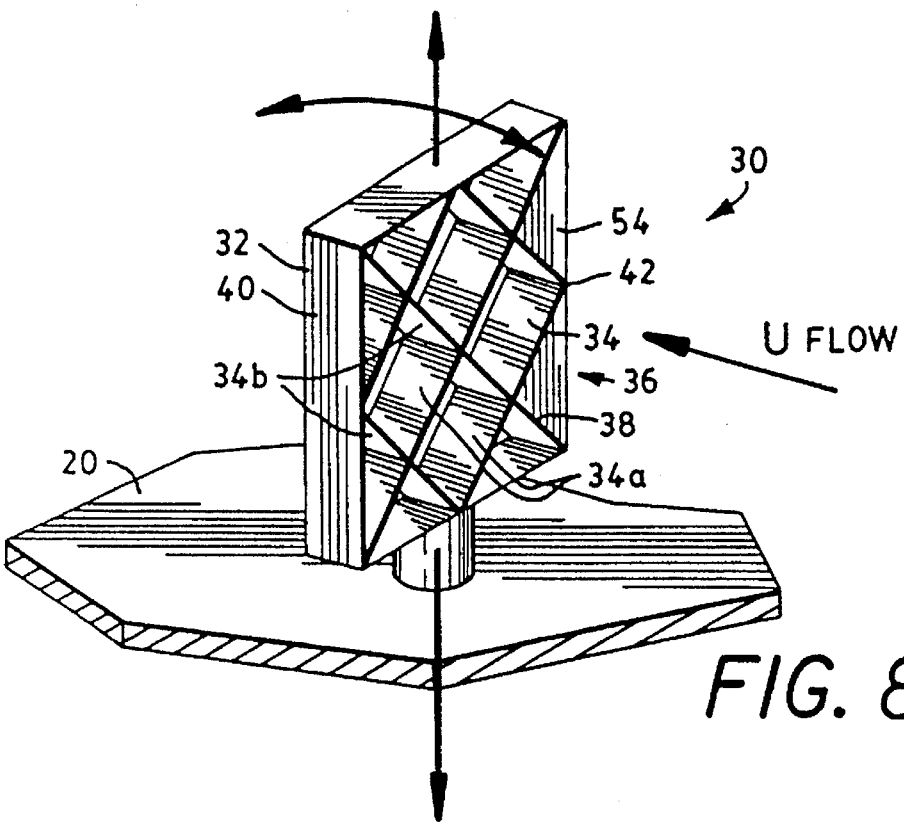
FIGS. 8 and 9 are perspective views of control and interconnect devices adapted for hinged movement forwardly and rearwardly.
Figure 9:
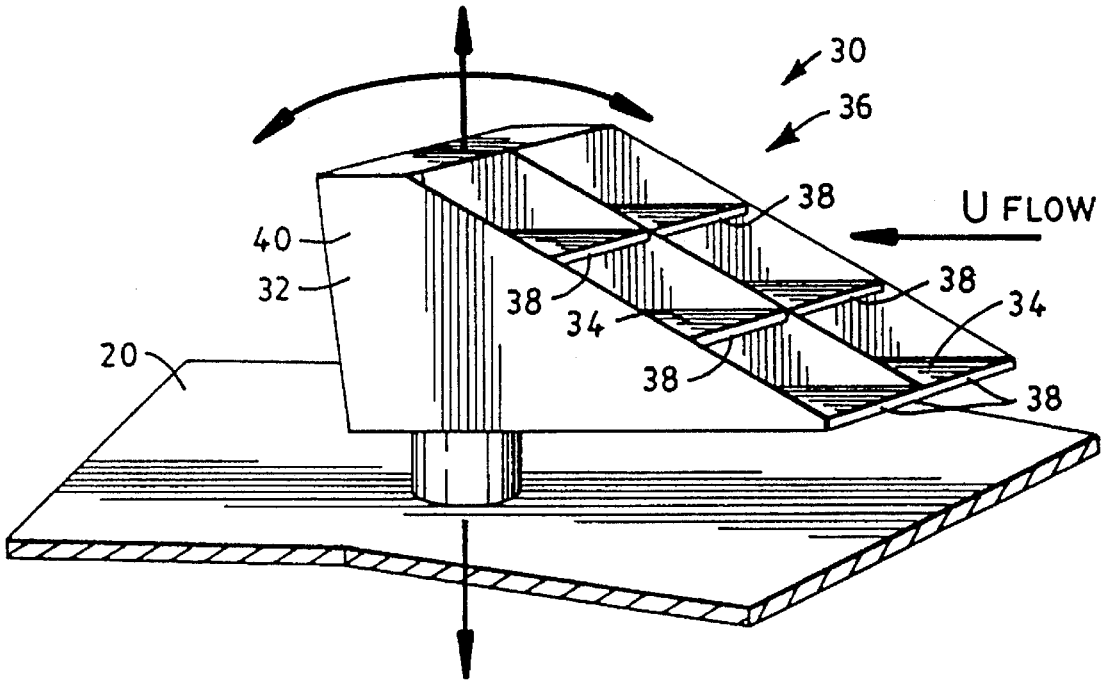

Referring to FIGS. 6 and 7, it will be seen that each array 36 may be rotatably mounted on the vehicle 20. Referring to FIGS. 8 and 9, it will be seen that each array 36 may be hingedly mounted, so as to be tiltable forwardly and rearwardly.

Figure 10:
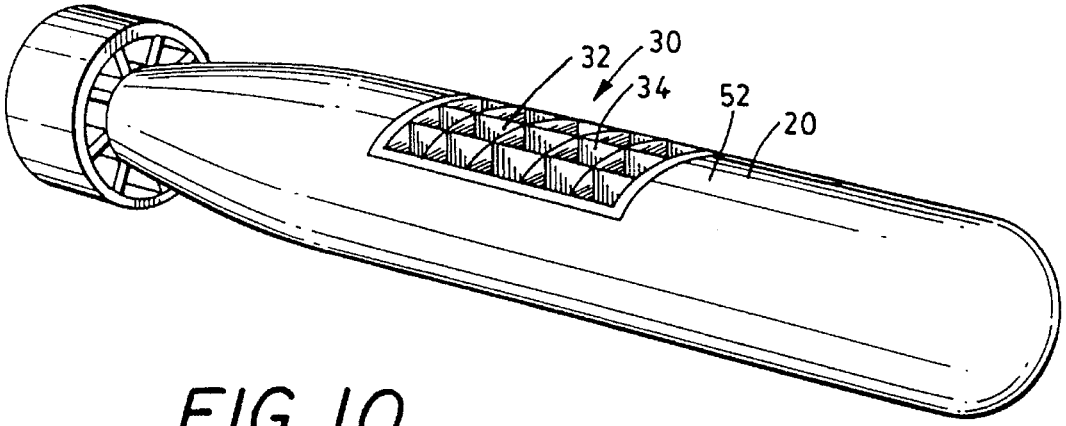
FIG. 10 is a perspective view of an underwater vehicle having pockets therein for stowing of directional control and cable interconnect devices, such that the devices are conformable to the vehicle.
Figure 11:
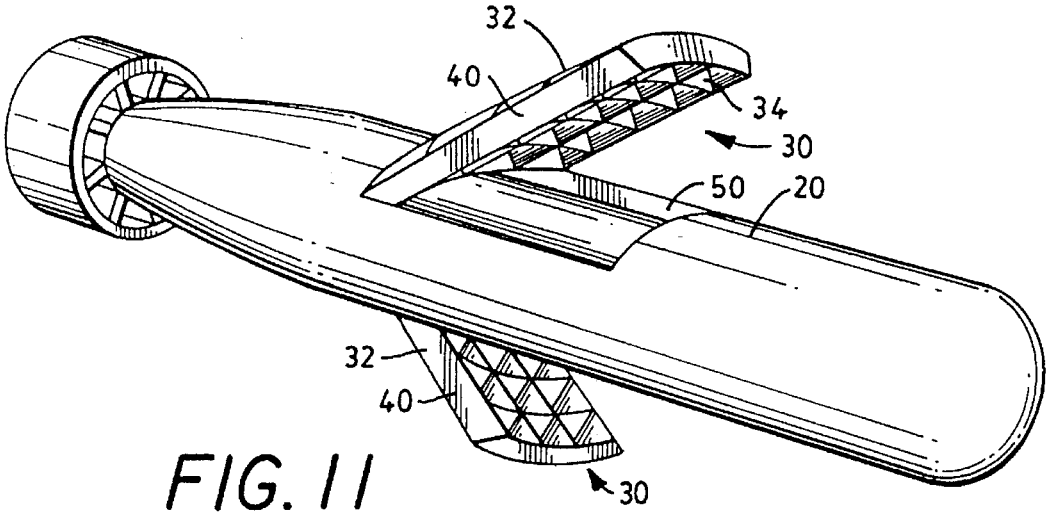
FIG. 11 is a perspective view similar to FIG. 10, but illustrative of movement of the control and interconnect devices from a stowed position to a deployed position.
Figure 12:
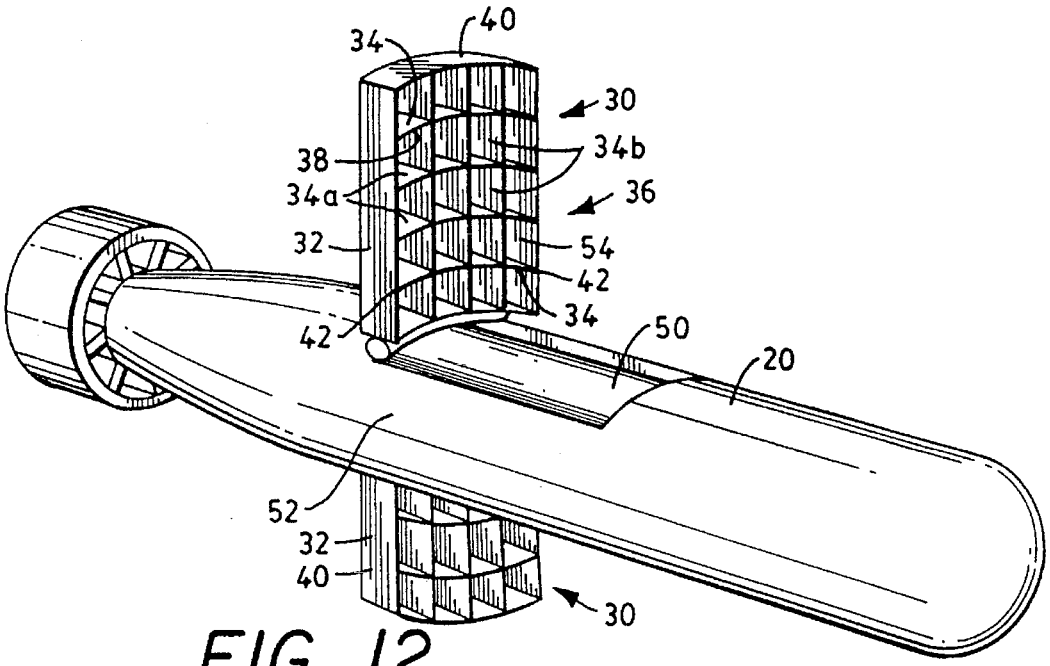
FIG. 12 is a perspective view similar to FIG. 11, but illustrative of the control and interconnect devices of FIG. 11 in their deployed position.

As illustrated in FIGS. 10–12, vehicle 20 preferably is provided with pockets 50. Each arm 32 is movable between a position in a pocket 50 wherein the arm 32 substantially conforms to an exterior surface 52 of vehicle 20 (FIG. 10) and a deployed position wherein arm 32 extends outwardly from exterior surface 52 of vehicle 20 (FIG. 12).

As seen in FIGS. 8 and 12, the array 36 of fins 34 may include a plurality of first fins 34*a* parallel to each other, and a plurality of second fins 3*b* parallel to each other and normal to first fins 34*a*. The first and second fins 34*a*, 34*b* intersect to form a grid-like configuration, with ends 42 of fins 34 fixed to an inside surface 54 of shroud 40.

In the embodiment illustrated in FIGS. 10–12, arms 32 may be extended by hydrodynamic forces acting thereon as vehicle 20 is launched, or may be extended by spring pressure which operates to fling arms 32 to the deployed position upon exit of the vehicle from a launch tube. Alternatively, the arms 32 may be selectively extended by power means operative upon signal from a transmitting station, or operable automatically upon lapse of a selected time, or the like.

In addition to the directional control capacity, the arms 32 and vehicle 20 are provided with the cable interconnect features shown and described in the aforementioned '194 patent.

In operation, during tube launch, or when vehicle 20 is moving at high speed, or when the array 36 otherwise is not needed, arms 32 are folded conformal to the body of vehicle 20 (FIG. 10). Upon deployment, the array presents fins 34 substantially parallel to the direction of flow (FIG. 12), minimizing drag. Yaw, pitch, and turning control forces are imparted by angling the array with respect to flow, that is, by angling the array forwardly or rearwardly, or by rotating the array.

Figure 14:
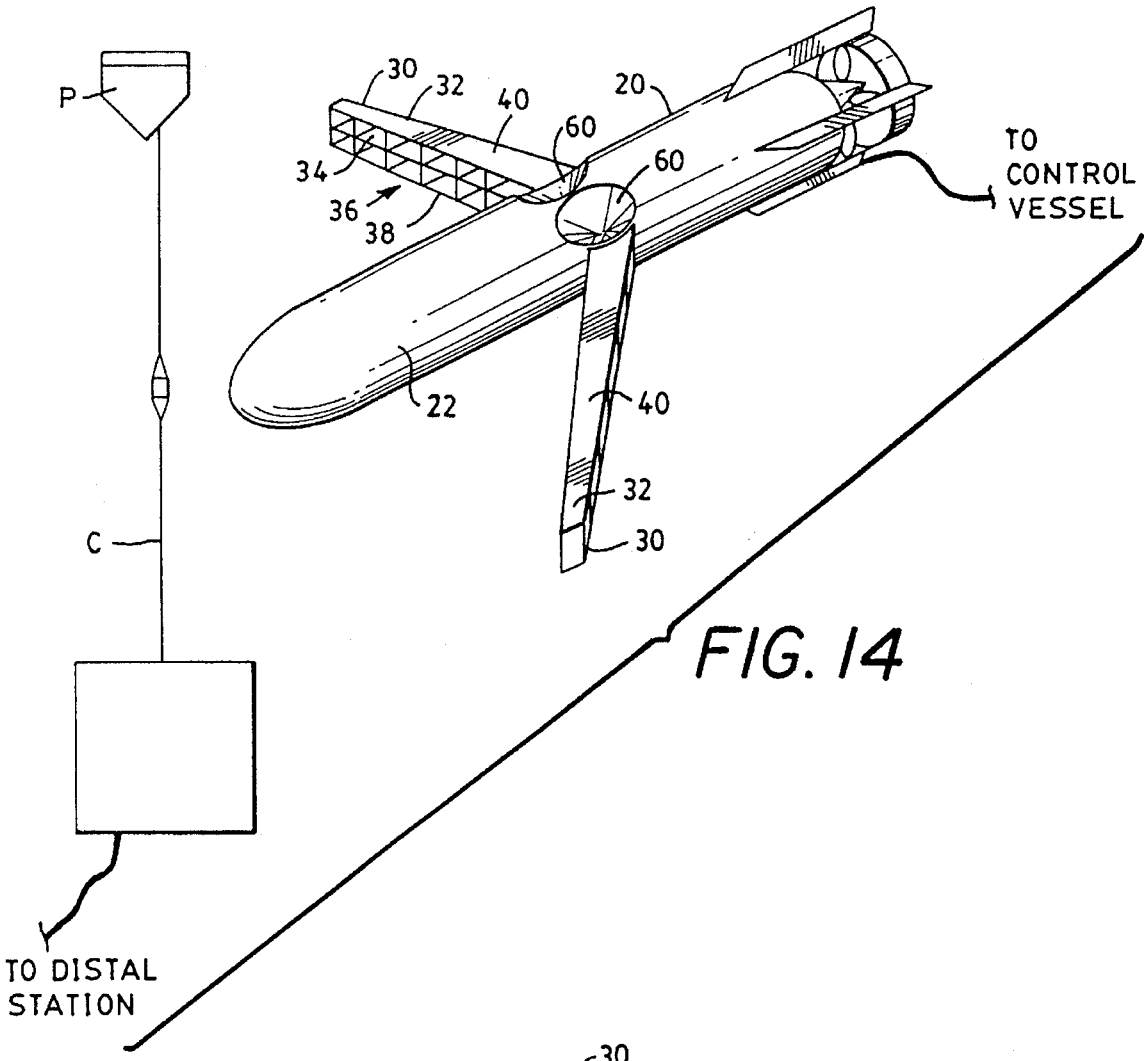
FIG. 14 is a perspective view of an underwater vehicle approaching a cable with the arms of the vehicle deployed for intercepting the cable.
Figure 13:
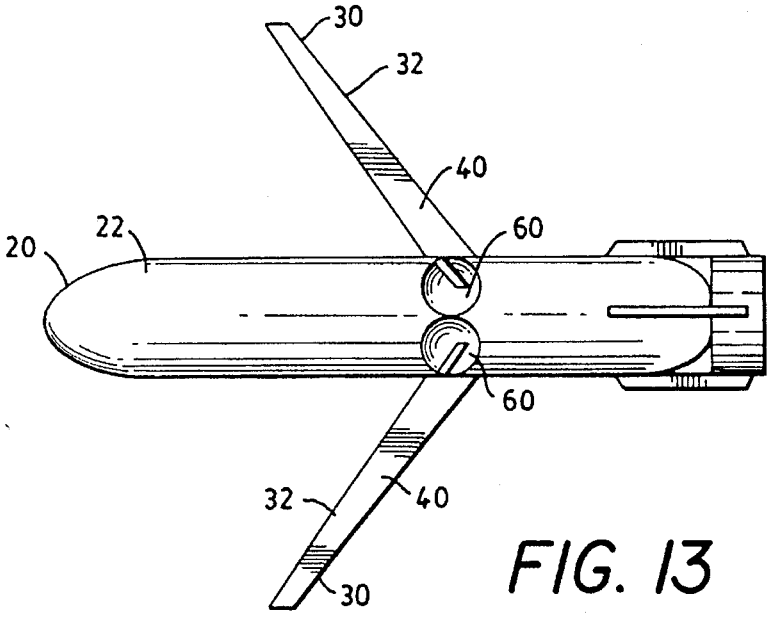
FIG. 13 is a top plan view of an underwater vehicle with arms deployed for maneuvering and for cable intercept, and showing pod reception means in the vehicle.

To intercept a cable C, arms 32, if not disposed in a forwardly tilting or curved attitude, are tilted forwardly, as shown in FIGS. 13 and 14, such that upon engagement with cable C the cable slides along an arm 32 to engage the vehicle 20. The vehicle 20 then slides along cable C until the vehicle engages a pod P. The vehicle 20 is provided with recess means 60 for engagement with pod P, shown herein but shown and described in the aforementioned '194 patent.

There is thus provided a water vehicle in combination with symmetrically disposed arms providing both directional control which affords high forces/moments at low speeds, simple operation, low power consumption, low acoustic signature and conformability to a launch tube, and cable intercept and interconnection means.

It is to be understood that the present invention is by no means limited to the particular construction herein disclosed and shown in the drawings, but also comprises any modification or equivalents within the scope of the claims. For example, while several specific arrangements of fins are illustrated, the fin array may be of any shape consistent with incompressible hydrodynamic flow, and may be optimized for lift, drag and/or cavitation properties of a particular vehicle at foreseen speed ranges.

What is claimed is:

1. An assembly comprising an underwater vehicle and a combination directional control and cable interconnection means therefor, said assembly comprising:

an underwater vehicle which remains underwater during travel of said vehicle through water and;

a combination directional control and cable interconnect means comprising arms extendible from sides of said vehicle, each of said arms including a multiplicity of fins in a compact array for contact with said water through which said vehicle moves in said travel; and each of said fins having a neutral lift, uncambered, shape of cross section chosen to substantially match the hydrodynamic streamline flow about the fin at a predetermined vehicle speed below cavitation threshold speed.

2. The assembly in accordance with claim 1 wherein said shape of cross section of a fin comprises a generally ellipsoidal leading edge with a taper pinched trailing edge.

3. The assembly in accordance with claim 1 wherein each of said arms further comprises a shroud surrounding said array of fins.

4. The assembly in accordance with claim 1 wherein each of said arms further comprises a shroud to which ends of fins in said array of fins are fixed.

5. The assembly in accordance with claim 3 wherein said array of fins includes a plurality of first fins parallel to each other, and a plurality of second fins parallel to each other and normal to said first fins, said first and second fins intersecting to form a grid-like configuration, with ends of said fins fixed to an inside surface of said shroud.

6. The assembly in accordance with claim 1 wherein said array of fins comprises said multiplicity of fins parallel to each other.

7. The assembly in accordance with claim 1 wherein each of said arms is rotatable about its axis.

8. The assembly in accordance with claim 1 wherein each of said arms is movable so as to be angled forwardly.

9. The assembly in accordance with claim 1 wherein said arm is hingedly movable in a fore-and-aft direction.

10. The assembly in accordance with claim 1 wherein said arms extend from said side of said vehicle at an attitude angled forwardly.

11. The assembly in accordance with claim 1 wherein said vehicle is provided with pockets, and each of said arms is movable between a position in one of said pockets wherein said arm substantially conforms to the exterior surface of said vehicle and a deployed position wherein said arm extends outwardly from said exterior surface of said vehicle.

12. The assembly in accordance with claim 11 wherein said underwater vehicle is launchable by a submerged submarine, and said arms in said pockets conform to a cylindrical configuration of said exterior surfaces of said vehicle to facilitate launch of said vehicle through a launch tube of said submarine.

13. The assembly in accordance with claim 12 wherein upon launch of said vehicle said arms are extendible by hydrodynamic forces acting thereon.

14. The assembly in accordance with claim 12 wherein upon launch of said vehicle said arms are extendible by spring pressure.

15. The assembly in accordance with claim 11 wherein said arms are extendible by power means.

* * * * *